US011933499B2

(12) United States Patent
Pugel et al.

(10) Patent No.: US 11,933,499 B2
(45) Date of Patent: Mar. 19, 2024

(54) REMOVABLE BOTTOM PANEL FOR AN OVEN APPLIANCE

(71) Applicant: Haier US Appliance Solutions, Inc., Wilmington, DE (US)

(72) Inventors: Joshua Pugel, South Jordan, UT (US); Blake Ellis, Greenville, SC (US); Hans Juergen Paller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 137 days.

(21) Appl. No.: 17/494,012

(22) Filed: Oct. 5, 2021

(65) Prior Publication Data

US 2023/0105085 A1 Apr. 6, 2023

(51) Int. Cl.
*F24C 15/00* (2006.01)
*F24C 15/32* (2006.01)

(52) U.S. Cl.
CPC ..... *F24C 15/007* (2013.01); *F24C 15/005* (2013.01); *F24C 15/32* (2013.01)

(58) Field of Classification Search
CPC ..... F24C 15/007; F24C 15/005; F24C 15/32; F24C 15/14; F24C 15/16
USPC ..... 126/19 R
See application file for complete search history.

(56) References Cited

U.S. PATENT DOCUMENTS 3,036,192 A 5/1962 Fry
3,120,224 A 2/1964 Divelbiss
6,121,584 A 9/2000 Key
6,552,305 B2 * 4/2003 De'Longhi ..... F24C 15/325 219/400
D553,905 S * 10/2007 Orr, Jr. ..... D7/390
10,634,362 B2 * 4/2020 Trice ..... F24C 7/062
11,110,883 B1 * 9/2021 Deng ..... B60R 21/264
2004/0074901 A1 * 4/2004 Kim ..... A47J 37/0814 219/679
2015/0047623 A1 * 2/2015 Wiggins ..... F24C 15/08 29/458
2015/0096550 A1 * 4/2015 Paller ..... F23D 14/10 126/21 R
2018/0020873 A1 * 1/2018 Chatot ..... A47J 36/2494 99/343
2022/0065459 A1 * 3/2022 Murad ..... G05D 23/1931

FOREIGN PATENT DOCUMENTS

CN 206137963 U 5/2017
CN 208002666 U 10/2018
EP 0594073 A3 8/1995

* cited by examiner

*Primary Examiner* — Allen R. B. Schult
*Assistant Examiner* — William C Weinert
(74) *Attorney, Agent, or Firm* — Dority & Manning, P.A.

(57) ABSTRACT

An oven appliance includes a plurality of sidewalls defining a cooking chamber, a door to selectively open and close the cooking chamber; and a bottom panel assembly removably provided within the cooking chamber. The bottom panel assembly includes a panel defining an aperture, a front air deflector attached to the panel at the aperture, and a retention clip provided within the cooking chamber, the retention clip defining a receiving slot to selectively receive the panel when the panel is in an installed position.

18 Claims, 5 Drawing Sheets

REMOVABLE BOTTOM PANEL FOR AN OVEN APPLIANCE

FIELD OF THE INVENTION

The present subject matter relates generally to oven appliances, and more particularly to panel assemblies for oven appliances.

BACKGROUND OF THE INVENTION

Generally, oven appliances include one or more heat sources to provide different styles of heating to a cooking chamber. One or more heat sources may be provided beneath the cooking chamber, e.g., along the vertical direction, to provide heat upward through a bottom panel of the cooking chamber. The bottom panel may thus protect the heat source from damage due to grease or food particles from cooked items within the cooking chamber. The bottom panel may thus collect much or all of the produced contaminants from the food items. Accordingly, the bottom panel may become dirty or damaged from food stuffs, stains, or certain elements bonding with the bottom panel.

Thus, the bottom panel must be cleaned at various intervals to maintain structural integrity, improve appearance, and prevent contamination of subsequent food items cooked within the cooking chamber. Currently, users of oven appliances must reach into the cooking chamber to scrub the panel, e.g., with a cleaning solution in order to clean the cooking chamber. Further, some conventional oven appliances include a high temperature pyrolytic cleaning operation which heats the cooking chamber up to very high temperatures in order to burn off or otherwise eliminate foreign contaminants from within the cooking chamber. However, each of these operations can be cumbersome, dangerous, inefficient, and ineffective.

Accordingly, a bottom panel for a cooking chamber of an oven appliance that allows for easier cleaning and maintenance would be beneficial. In detail, an easily removable bottom panel for a cooking chamber of an oven appliance would be particularly useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an oven appliance is provided. The oven appliance may define a vertical direction, a lateral direction, and a transverse direction. The oven appliance may include a plurality of sidewalls defining a cooking chamber within a cabinet; a door movable between an open position and a closed position to selectively open and close the cooking chamber; and a bottom panel assembly removably provided within the cooking chamber. The bottom panel assembly may include a panel defining a front end, a rear end opposite the front end, a first side, a second side opposite the first side, and an aperture defined therethrough along the vertical direction; a front air deflector attached to the panel proximate the aperture, the front air deflector protruding along the vertical direction and at least partially covering the aperture; and a retention clip provided within the cooking chamber, the retention clip defining a receiving slot to selectively receive the panel when the panel is in an installed position.

In another exemplary aspect of the present disclosure, a panel assembly for an oven appliance is provided. The oven appliance may include first and second side walls and a rear wall collectively defining a cooking chamber. The panel assembly may include a panel defining a front end, a rear end opposite the front end, a first side, a second side opposite the first side, and an aperture defined therethrough along the vertical direction; a front air deflector attached to the panel proximate the front end, the front air deflector protruding along the vertical direction and at least partially covering the aperture; and a retention clip provided within the cooking chamber, the retention clip defining a receiving slot to selectively receive the panel when the panel is in an installed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
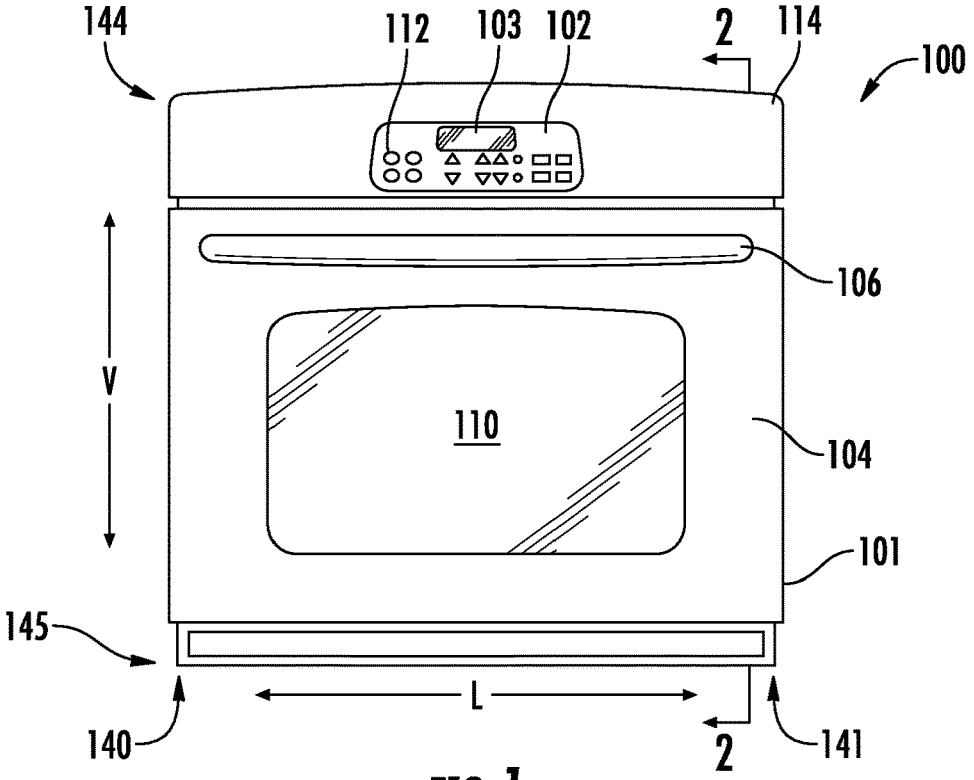
FIG. 1 provides a front view of an oven appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
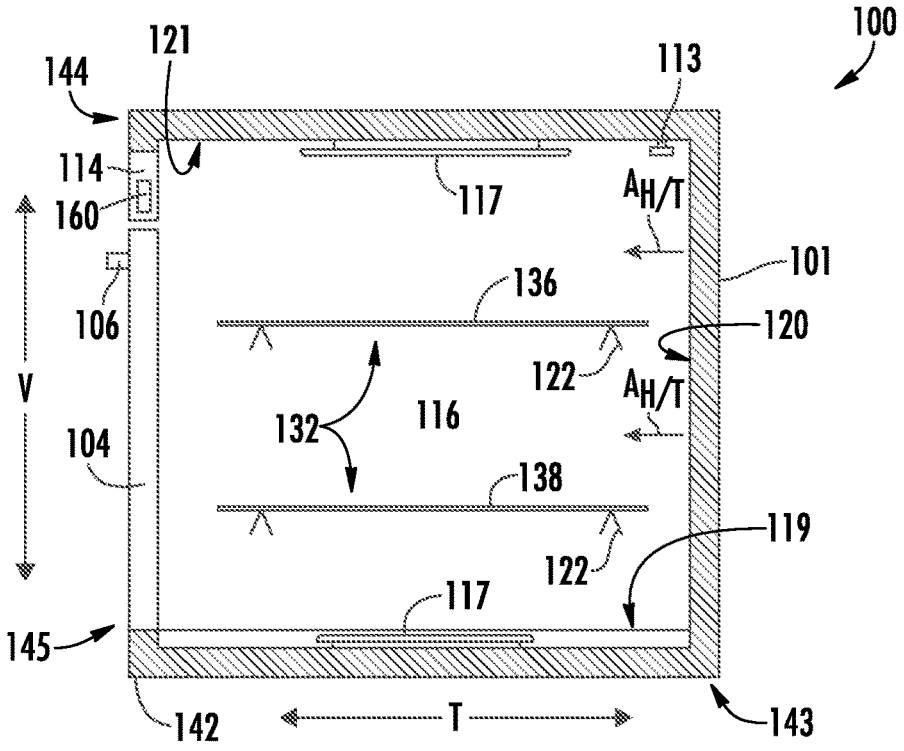
FIG. 2 provides a side view of the exemplary oven appliance of FIG. 1.

Referring to FIGS. 1 and 2, an exemplary embodiment of an oven appliance 100 for heating is shown according to the present disclosure. In particular, FIG. 1 provides a front view of the oven appliance 100. FIG. 2 provides a cross-sectional view of the oven appliance 100 taken along the 2-2 axis shown in FIG. 1. The oven appliance 100 includes a cabinet or housing 101 with a cooking chamber 116 positioned therein.

The cabinet 101 may extend between a first side 140 (FIG. 1) and a second side 141 (FIG. 1) along a lateral direction L. Further, the cabinet 101 may also extend between a front 142 (FIG. 2) and a back 143 (FIG. 2) along a transverse direction T. The cabinet 101 may further extend between a top 144 and a bottom 145 along a vertical direction V. Transverse direction T is substantially perpendicular to lateral and vertical directions L, V. Thus, vertical direction V, lateral direction L, and transverse direction T are orthogonally oriented such that vertical direction V, lateral direction L, and transverse direction T form an orthogonal directional system.

Moreover, the chamber 116 may include a plurality of sidewalls including opposing sidewalls 118 (FIG. 3), bottom wall 119 (described in more detail below), back wall 120, and top wall 121 that define cooking chamber 116. Bottom wall 119 and top wall 121 are spaced apart along the vertical direction V, and sidewalls 118 extend along the vertical direction V between top wall 121 and bottom wall 119. Back wall 120 extends between sidewalls 118 along the lateral direction L and also extends between top wall 121 and bottom wall 119 along the vertical direction V.

Sidewalls 118 include supports 122 (FIG. 2) for supporting oven racks 132 (FIG. 2) that may be selectively positioned within chamber 116. Oven racks 132 include a top rack 136 and a bottom rack 138. Top rack 136 is positioned above bottom rack 138 along the vertical direction V. Additional supports 122 may be provided at or near a bottom of cooking chamber 116 to support bottom wall 119, which will be described in further detail below.

The oven appliance 100 may also include a door 104 with handle 106 that provides for opening and closing access to a cooking chamber 116. A user of the oven appliance 100 can place a variety of different items to be cooked in chamber 116 onto racks 132. Heating elements 117 may be positioned at the top and the bottom of chamber 116 to provide heat for cooking and cleaning. Such heating element(s) can be e.g., gas, electric, microwave, or a combination thereof. Other heating elements (not shown) could be located at other locations as well. A window 110 on door 104 allows the user to view e.g., food items during the cooking process.

Referring to FIG. 1, the oven appliance 100 may include a user interface 102 having a display 103 positioned on top panel 114 with a variety of controls 112. In certain embodiments, the interface 102 allows the user to select various options for the operation of oven appliance 100 including e.g., temperature, time, and/or various cooking and cleaning cycles. Operation of the oven appliance 100 can be regulated by a controller 160 (FIG. 2) that is operatively coupled e.g., in communication with, user interface panel 102, heating element(s), and other components of oven appliance 100 as will be further described.

For example, in response to user manipulation of the user interface panel 102, the controller 160 can operate heating element(s). The controller 160 can receive measurements from a temperature sensor 113 (FIG. 2) placed in cooking chamber 116 and e.g., provide a temperature indication to the user with display 103. By way of example, the controller 160 may include a memory and one or more processing devices such as microprocessors, CPUs, or the like, such as general or special purpose microprocessors operable to execute programming instructions or micro-control code associated with operation of appliance 100. The memory may represent random access memory such as DRAM, or read only memory such as ROM or FLASH. In one exemplary embodiment, the processor executes programming instructions stored in memory. The memory may be a separate component from the processor or may be included onboard within the processor.

The controller 160 may be positioned in a variety of locations throughout appliance 100. Thus, the controller 160 may be located under or next to the user interface 102 or otherwise within top panel 114. In an exemplary embodiment, input/output ("I/O") signals are routed between the controller 160 and various operational components of appliance 100 such as heating element(s), controls 112, display 103, sensor(s), alarms, and/or other components as may be provided. In one exemplary embodiment, the user interface panel 102 may represent a general purpose I/O ("GPIO") device or functional block.

Although shown with touch type controls 112, it should be understood that controls 112 and the configuration of the oven appliance 100 shown in FIG. 1 is provided by way of example only. More specifically, user interface 102 may include various input components, such as one or more of a variety of electrical, mechanical, or electro-mechanical input devices including rotary dials, push buttons, and touch pads. The user interface 102 may include other display components, such as a digital or analog display device designed to provide operational feedback to a user. The user interface 102 may be in communication with the controller 160 via one or more signal lines or shared communication busses. Also, the oven appliance 100 is shown as a wall oven but the present invention could also be used with other appliances such as e.g., a stand-alone oven, an oven with a stove-top, and other configurations as well.

FIGS. 3 through 9 illustrate a panel assembly according to exemplary embodiments of the present disclosure. As discussed above, the plurality of sidewalls 118 defining cooking chamber 116 may include bottom wall 119. Bottom wall 119 may be formed as a removable panel assembly 170. In detail, removable panel assembly 170 may form bottom wall 119 of cooking chamber 116, and may be removable from cabinet 101 (e.g., for cleaning, replacement, etc.). According to at least some embodiments, panel assembly 170 may be removed without the use of any tools (e.g., screwdrivers, drills, clips, etc.). Thus, panel assembly 170 may be easily inserted and removed from cabinet 101.

Panel assembly 170 may include a panel 172. Panel 172 may be formed from a first material. The first material may be the same as the plurality of sidewalls forming cooking chamber 116. In at least one embodiment, panel 172 is formed from a metal. Additionally or alternatively, panel 172 may be coated with a predetermined enamel. The predetermined enamel coating may be a waterproof coating, for example, allowing panel 172 to be easily cleaned (e.g., in a dishwasher appliance). In some embodiments, the enamel coating is a non-stick enamel coating, increasing the cleanability of panel assembly 170.

Figure 3:
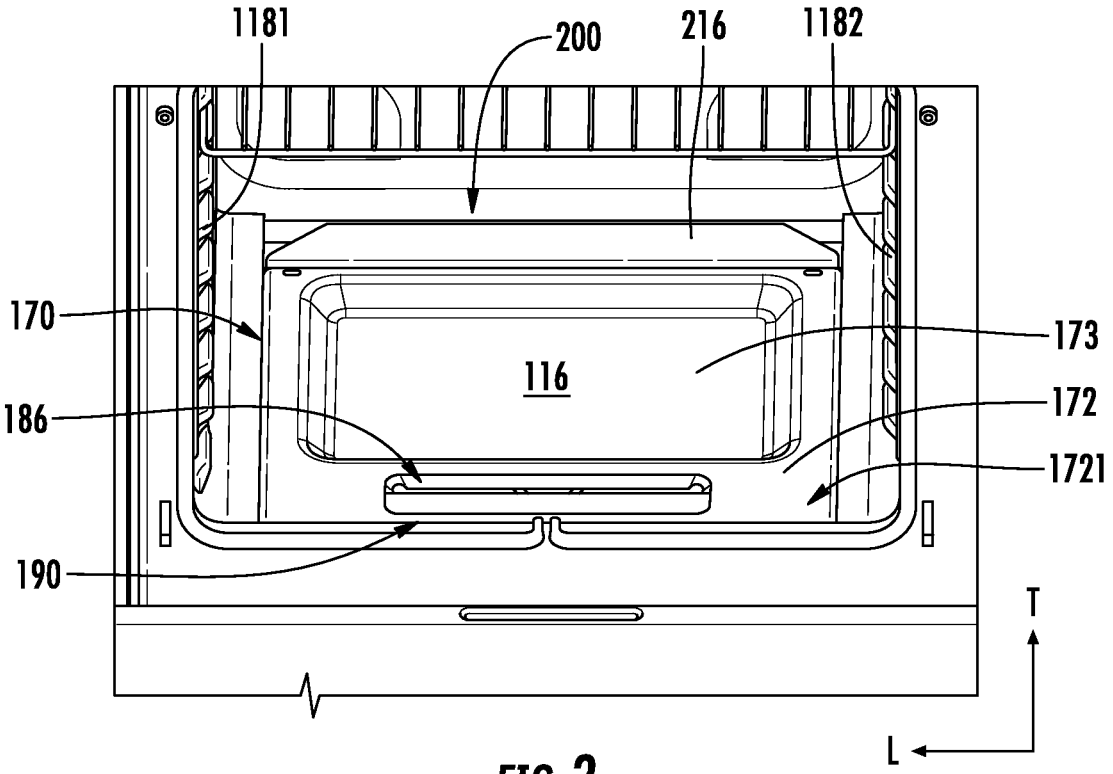
FIG. 3 provides a top perspective view of an interior cooking chamber of the exemplary oven appliance of FIG. 1.
Figure 4:
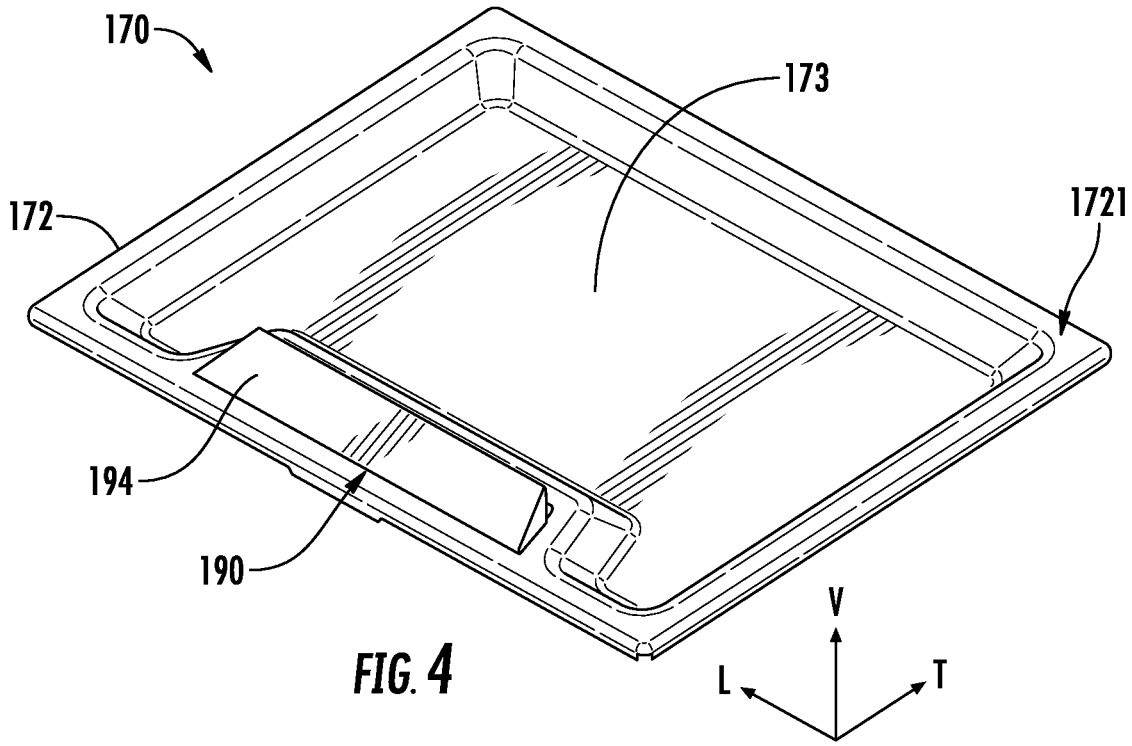
FIG. 4 provides a perspective view of a bottom panel assembly according to exemplary embodiments of the present disclosure.

Panel 172 may include a depression 173. For instance, a central portion of panel 172 may be concave along the vertical direction V (e.g., downward along the vertical direction V) to form depression 173 therein. Advantageously, depression 173 may increase a volumetric size of cooking chamber 116. Additionally or alternatively, depression 173 may store a liquid (e.g., water) therein during a cooking operation in order to produce steam or a steam effect within cooking chamber 116. The steam effect may be utilized in a cooking operation or a cleaning operation. Depression 173 may have any suitable shape. In at least one example, as shown in FIG. 3, depression 173 is rectangular in shape (e.g., along the lateral direction L and the transverse direction T). In at least another example, as shown in FIG. 4, depression 173 includes one or more notches formed therein (e.g., along the transverse direction T). Thus, depression 173 may have any suitable shape formed into panel 172.

Panel 172 may define a front end 174 and a rear end 176 opposite the front end 174 (e.g., along the transverse direction T). For instance, when panel assembly 170 is in an installed position within cooking chamber 116, front end 174 may be proximate door 104 while rear end 176 may be proximate back wall 120. Panel 172 may further define a first side 177 and a second side 178 opposite first side 177 (e.g., along the lateral direction L). In some embodiments, when panel assembly 170 is in the installed position, first side 177 is proximate a first sidewall 1181 while second side 178 is proximate an opposing sidewall 1182. Accordingly, panel 170 (e.g., defining bottom wall 119) may cover one or more heating elements 117 (e.g., provided at a bottom of cabinet 101) along the vertical direction V when panel assembly 170 is in the installed position.

Panel 172 may include an aperture 180 defined therethrough (e.g., along the vertical direction V. Aperture 180 may allow fluid communication between heating element 117 (e.g., a heating element chamber) and cooking chamber 116. In detail, heat (or heated air) produced by heating element 117 may flow through aperture 180 into cooking chamber 116 to cook or heat items provided within cooking chamber 116. Aperture 180 may define a lateral axis 182 (e.g., along the lateral direction L) and a transverse axis 184 (e.g., along the transverse direction T). In at least some embodiments, lateral axis 182 is longer than transverse axis 184. Aperture 180 may be located proximate front end 174 of panel 172. Additionally or alternatively, aperture 180 may be provided adjacent to depression 173. Accordingly, the heat or heated air from heating element 117 (heating element chamber) may be provided to a front portion of cooking chamber 116 via aperture 180.

Panel assembly 170 may include a front air deflector 190. Front air deflector 190 may be attached to panel 170. For instance, front air deflector 190 may be attached to a top surface 1721 of panel 172 and protrude generally along the vertical direction V. Further, front air deflector 190 may extend generally along the lateral direction L (e.g., predominantly parallel to aperture 180). According to at least some embodiments, front air deflector 190 is made from a second material different from the first material. In detail, front air deflector 190 may be made from a material different from that of panel 172. Advantageously, front air deflector 190 may include one or more materials different from those of panel 172, creating more favorable air flow patterns and reducing fatigue of certain parts of panel assembly 170. Front air deflector 190 may be attached to panel 172 via fasteners (e.g., screws, bolts, clips, rivets, etc.). It should be noted that any suitable fastener or fasteners may be used to attach front air deflector 190 to panel 172.

Front air deflector 190 may include a base 192. Front air deflector 190 may be attached to panel 172 via base 192. For instance, base 192 may extend along the lateral direction L and the transverse direction T. Accordingly, as shown most clearly in FIG. 7, base 192 may be in planar contact with panel 172 (e.g., with top surface 1721 of panel 172). Base 192 may be attached to panel 172 proximate aperture 180. In some embodiments, base 192 is located closer to front end 174 of panel 172 than aperture 180. In other words, base 192 may be provided between aperture 180 and front end 174 of panel 172 along the transverse direction T. A length along the lateral direction L of base 192 may be greater than a length along the lateral direction L of aperture 180.

Front air deflector 190 may include a handle portion 194. Handle portion 194 may extend from base 192, e.g., at a predetermined angle with respect to base 192 (or panel 172). For instance, handle portion 194 may extend generally in the vertical direction V and the transverse direction T. The predetermined angle may be between about 25° and about 35° with respect to base 192. In some examples, handle portion 194 extends toward a center of cooking chamber 116. Thus, the handle portion 194 may partially cover aperture 180. Additionally or alternatively, front air deflector 190 may be referred to or operate primarily as a handle altogether. In detail, the design and positioning of front air deflector 190 may be particularly well suited to allow a user to easily grasp and lift to remove panel 172 from cooking chamber 116.

In detail, handle portion 194 may extend upward and rearward (e.g., along the vertical and transverse directions V and T) from base 192. In the case where base is provided between aperture 180 and front end 174 of panel 172, handle portion 194 extends to partially cover aperture 180. Accordingly, front air deflector 190 (e.g., handle portion 194) may define an outlet 186 together with aperture 180. Heat or heated air from heating element 117 may be directed into cooking chamber 116 via outlet 186. Advantageously, since handle portion 194 is angled toward the center of cooking chamber 116, a circulated air pattern may be formed within cooking chamber 116 to more evenly cook or heat items (e.g., food) within cooking chamber 116. Additionally or alternatively, handle portion 194 may be grasped by a user in order to easily remove panel 172 (or panel assembly 170) from cooking chamber 116.

Front air deflector 190 may include side members 196 and 198. For instance, a first side member 196 may connect a first lateral end of base 192 to a first lateral end of handle portion 194. Similarly, a second side member 198 may connect a second lateral end of base 192 to a second lateral end of handle portion 194, the second lateral ends being opposite the first lateral ends along the lateral direction L. Side members 196 and 198 may provide rigidity to front air deflector 190 and assist in directing the heat or heated air from heating element 117 toward cooking chamber 116. Moreover, side members 196 and 198 may assist in locating front air deflector 190 with respect to panel 172 (and aperture 180) during assembly.

Oven appliance 100 may include a retention clip 200. It should be noted that retention clip 200 may or may not function as a traditional "clip." For instance, as will be described in further detail below, retention clip 200 may passively restrain panel 172 from moving or expanding in the vertical direction V and transverse direction T. According to at least some embodiments, retention clip 200 is part of (e.g., included with) panel assembly 170. For instance, panel 172, front air deflector 190, and retention clip 200 may collectively form panel assembly 170. In other embodiments, retention clip 200 is installed within cooking chamber 116 to receive panel 172. Accordingly, retention clip 200 may be provided within cooking chamber 116. For instance, retention clip 200 may be fixed within cooking chamber 116 at a rear lower portion thereof. Retention clip 200 may interact with panel 172. In at least one example, retention clip 200 selectively receives panel 172 when panel 172 (e.g., panel assembly 170) is in the installed position. For purposes of this disclosure, panel assembly 170 is determined to be in the installed position when inserted into cooking chamber 116, forming bottom wall 119 of cooking chamber 116. For instance, retention clip 200 may define a receiving slot 208 into which rear end 176 of panel 172 is selectively inserted.

Figure 5:
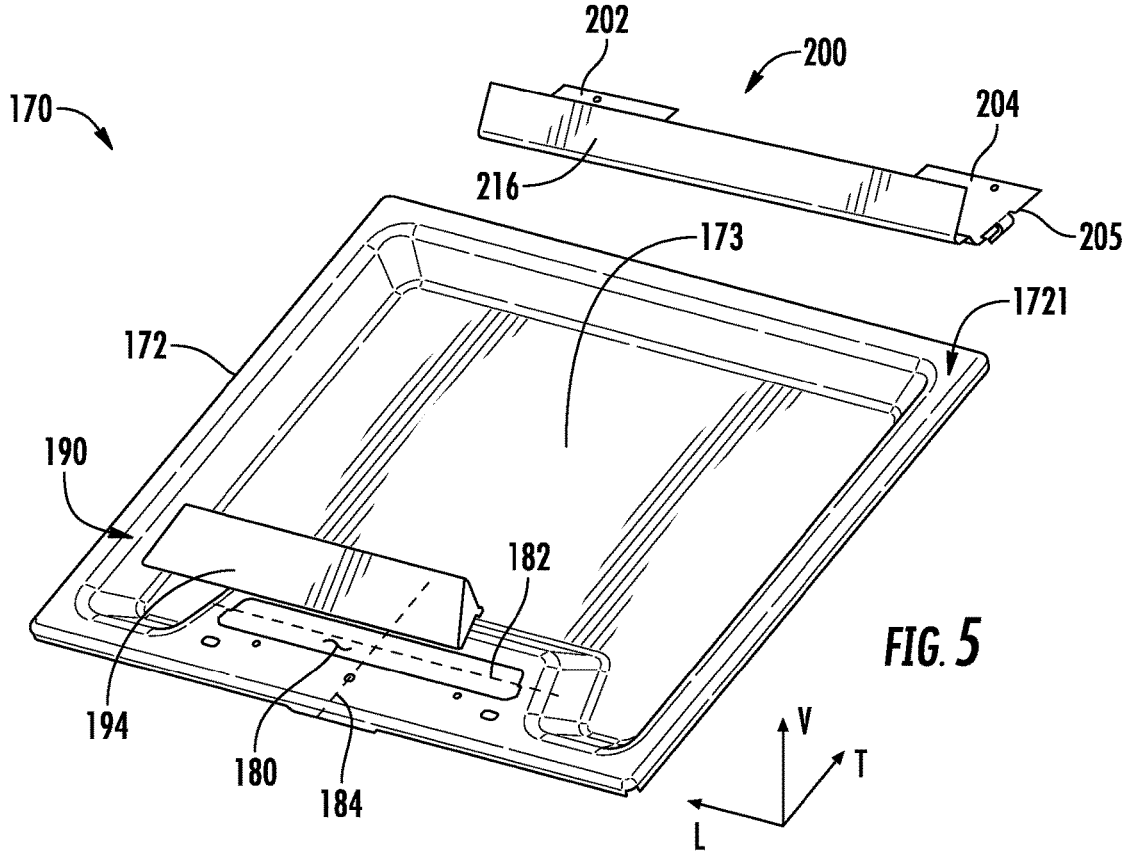
FIG. 5 provides an exploded perspective view of the exemplary bottom panel assembly of FIG. 4.
Figure 6:
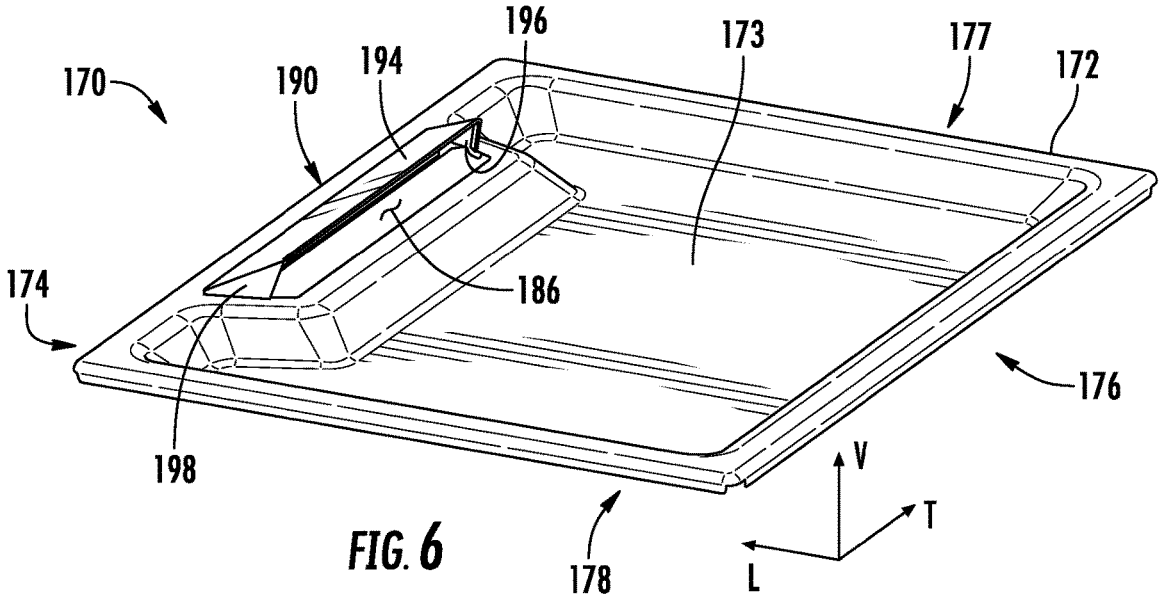
FIG. 6 provides a rear perspective view of the exemplary bottom panel assembly of FIG. 4.
Figure 7:
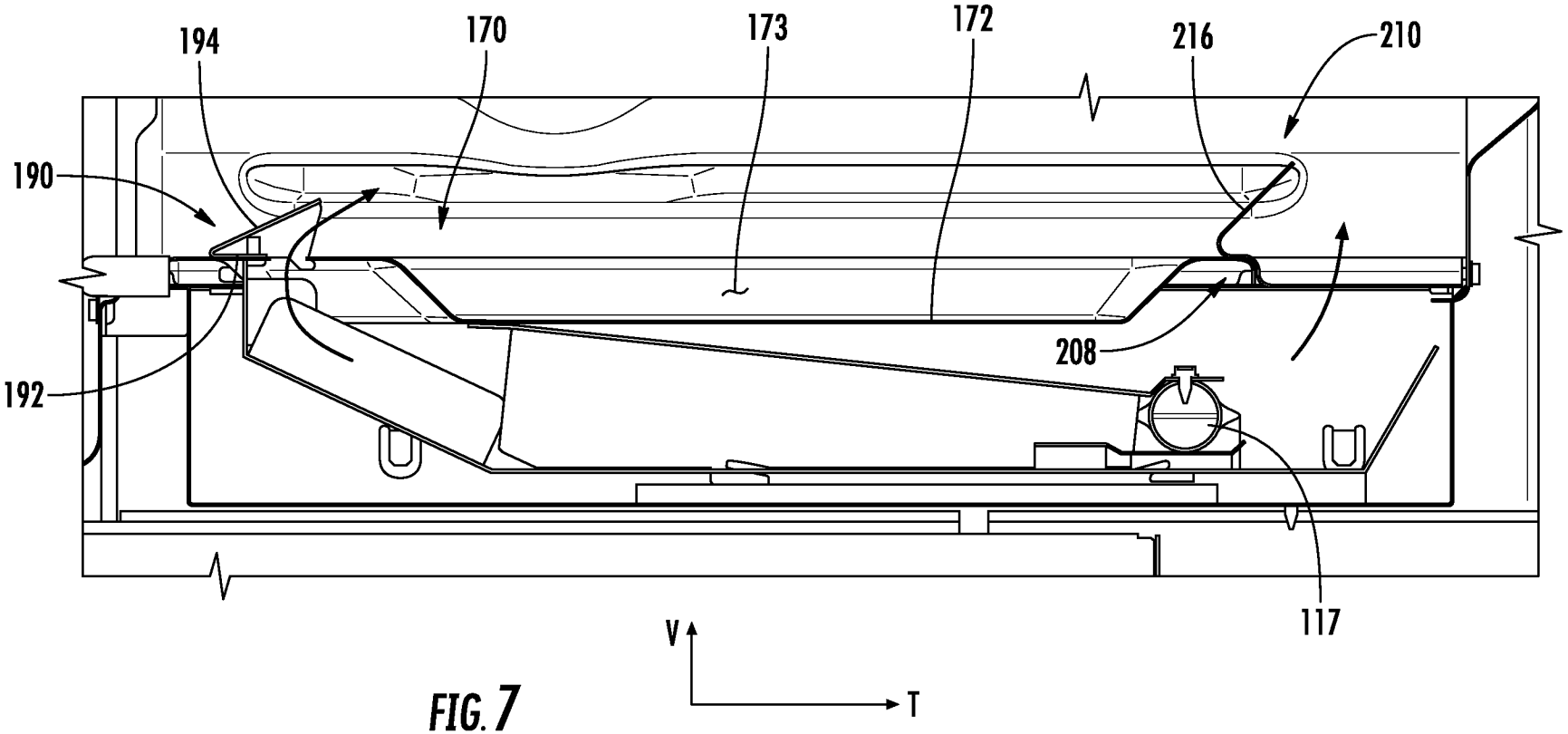
FIG. 7 provides a side cut-away view of the exemplary bottom panel assembly of FIG. 4.
Figure 9:
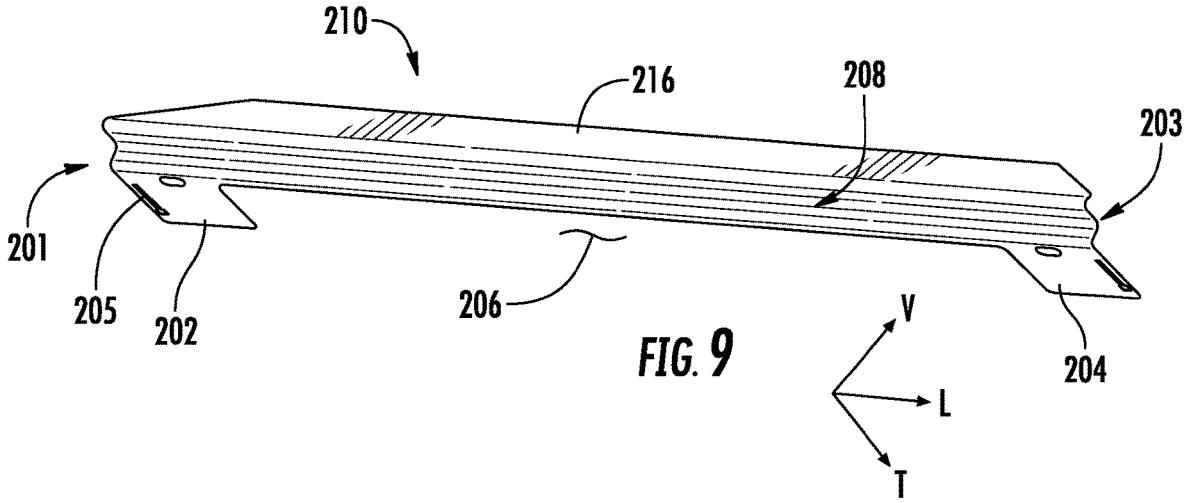
FIG. 9 provides a bottom perspective view of a retention clip according to exemplary embodiments of the present disclosure.

Retention clip 200 may include a first support foot 202 and a second support foot 204. Referring briefly to FIGS. 5 and 9, first support foot 202 may be provided at a first lateral end 201 of retention clip 200. Similarly, second support foot 204 may be provided at a second lateral end 203 of retention clip 200, opposite first lateral end 201. Each of first support foot 202 and second support foot 204 may have similar design and construction, and as such, first support foot 202 will be described in full with the understanding that the description applies to second support foot 204 as well.

First support foot 202 may extend in the lateral direction L and the transverse direction T. In detail, first support foot 202 may be parallel with panel 172 (e.g., top surface 1721 of panel 172). According to at least some embodiments, first support foot 202 is attached to a first sidewall 1181. For instance, an outer lateral edge 205 of first support foot 202 may be attached to first sidewall 1181. In some embodiments, outer lateral edge 205 includes a clip which is inserted into a receiving notch formed in first sidewall 1181. However, any number of fastening means may be used to attach first support foot 202 to first sidewall 1181, such as screws, bolts, rivets, adhesives, or the like.

Figure 8:
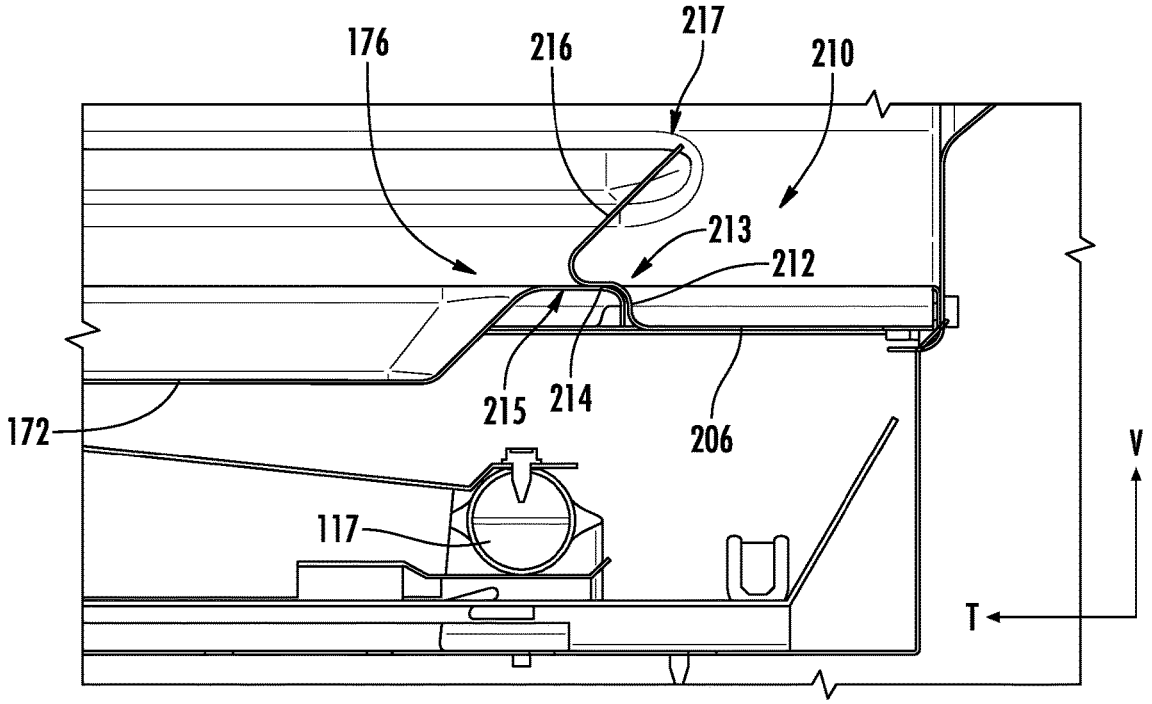
FIG. 8 provides an enlarged side cut-away view of the exemplary bottom panel assembly of FIG. 7.

As mentioned above, second support foot 204 may be similarly designed as first support foot 202. For instance, second support foot 204 may be attached to a second sidewall 1182 opposite first sidewall 1181 (e.g., via an outer lateral edge 205). Additionally or alternatively, a gap 206 may be formed between first support foot 202 and second support foot 204. Gap 206 may allow fluid communication between heating element 117 (e.g., heating element chamber) and cooking chamber 116 (e.g., at a rear of oven appliance 100). Gap 206 may be defined between first support foot 202 and second support foot 204 along the lateral direction L, and between rear end 176 of panel 172 and back wall 120. Accordingly, rear end 176 of panel 172 may be spaced apart from back wall 120 of cabinet 101 along the transverse direction T (e.g., when panel assembly 170 is in the installed position, as shown in FIG. 8).

Retention clip 200 may include a restraining member 210. For instance, restraining member 210 may be attached to each of first support foot 202 and second support foot 204, thereby connecting first support foot 202 to second support foot 204. Restraining member 210 may selectively restrain rear end 176 of panel 172 along the vertical direction V and transverse direction T. In detail, when panel assembly 170 is in the installed position, restraining member 210 may prohibit panel 172 from moving or shifting rearward along the transverse direction T (e.g., toward back wall 120) and upward along the vertical direction V (e.g., toward top wall 121). Restraining member 210 may extend laterally across cooking chamber 116. Thus, an entire lateral length of panel 172 (e.g., rear end 176) may be restrained by restraining member 210 when in the installed position.

Retraining member 210 may include a first locking crossmember 212. First locking crossmember 212 may protrude along the vertical direction V. For instance, first locking crossmember 212 may be defined along the vertical direction V and the lateral direction L (i.e., first locking crossmember 212 may extend along the lateral direction L). First support foot 202 and second support foot 204 may be connected to first locking crossmember 212. For instance, first support foot 202 and second support foot 204 may be substantially perpendicular to first locking crossmember 212. In some embodiments (e.g., as shown in FIG. 8), a junction of first locking crossmember 212 and first and second support feet 202, 204 may be filleted, rounded, or chamfered. Rear end 176 of panel 172 may be adjacent to first locking crossmember 212 when panel assembly 170 is in the installed position. In some embodiments, rear end 176 abuts first locking crossmember 212 in the installed position. In still other embodiments, a gap (e.g., thermal expansion gap) is provided between rear end 176 and first locking crossmember 212 in the installed position.

Restraining member 210 may include a second locking crossmember 214. Second locking crossmember 214 may protrude from first locking crossmember 212. In detail, second locking crossmember 214 may protrude from a distal edge 213 of first locking crossmember 212. Distal edge 213 may be a top of first locking crossmember 212 (e.g., along the vertical direction V). Second locking crossmember 214 may protrude along the transverse direction T. Similar to first locking crossmember 212, second locking crossmember 214 may extend along the lateral direction L. Second locking crossmember 214 may be substantially perpendicular to first locking crossmember 212. In some embodiments (e.g., as shown in FIG. 8), a junction of first locking crossmember 212 and second locking crossmember 214 may be filleted, rounded, or chamfered.

Second locking crossmember 214 may be adjacent to panel 172, e.g., at or near rear end 176. In detail, when panel assembly 170 is in the installed position, rear end 176 may be positioned beneath second locking crossmember 214 along the vertical direction V. In some embodiments, top surface 1721 of panel 172 contacts second locking crossmember 214 (e.g., in the installed position). For instance, panel 172 may clip or snap under second locking crossmember 214. In still other embodiments, a gap (e.g., thermal expansion gap) is provided between top surface 1721 of panel 172 and second locking crossmember 214. As described above, first locking crossmember 212 and second locking crossmember 214 may collectively define receiving slot 208.

Restraining member 210 may include a rear air deflector 216. Rear air deflector 216 may protrude from second locking crossmember 214. In detail, rear air deflector 216 may protrude from a distal edge 215 of second locking crossmember 214. Rear air deflector 216 may protrude at an acute angle with respect to second locking crossmember 214. For instance, as shown in FIG. 8, rear air deflector 216 may protrude upward and rearward, e.g., along the vertical direction V and the transverse direction T, toward back wall 120. Accordingly, an acute angle (e.g., less than 90°) may be formed between second locking crossmember 214 and rear air deflector 216. Rear air deflector 216 may further extend along the lateral direction L. In some embodiments, the lateral edges of rear air deflector 216 may taper inward toward a distal edge 217 of rear air deflector 216. In some embodiments (e.g., as shown in FIG. 8), a junction of second locking crossmember 212 and rear air deflector 216 may be filleted, rounded, or chamfered.

A portion of rear air deflector 216 may be positioned over gap 206. For instance, distal edge 217 of rear air deflector 216 may be provided vertically above gap 206. Thus, heat or heated air from heating element 117 may be directed (at least partially) by rear air deflector 216 toward back wall 120 of cooking chamber 116. Advantageously, a more even distribution of heat or heated air may be induced within cooking chamber 116, leading to improved heating characteristics and efficiencies.

Each of panel 172, front air deflector 190, and retention clip 200 may be coated with the predetermined enamel. As described briefly above, the predetermined enamel may be a waterproof coating, a heat resistant coating, a scratch resistant coating, a bond resistant coating, or the like. Additionally or alternatively, the predetermined enamel may add structural strength to each piece and increase rigidity under high heating. Further, the predetermined enamel may prevent deformation from uneven heating. Further, the predetermined enamel may allow each piece to be more easily cleaned (e.g., by hand or in a dishwasher appliance). Additionally or alternatively, different predetermined enamels may be applied to each piece. For instance, panel 172 may be coated in a first enamel, front air deflector 190 may be coated in a second enamel, and retention clip 200 may be coated in a third enamel. Moreover, any suitable combination of enamels may be applied to any combination of pieces, according to specific embodiments.

The present disclosure describes a removable oven bottom panel for easy cleaning and improved air circulation within a cooking chamber of an oven appliance. The removable oven bottom may include a panel assembly including a panel, a front air deflector, and a retention clip. The retention clip may selectively restrain the panel in an installed position to prevent movement during cooking processes. The front air deflector and the retention clip may assist in circulating heat or heated air within the cooking chamber to improve cooking or heating performance. Each piece of the panel assembly may be coated with a predetermined enamel to improve structural rigidity and aid in cleaning of the pieces. Because the panel is selectively received within the cooking chamber, the panel may be easily removed for cleaning. No fasteners may be used to hold the panel assembly in place, further increasing the ease of removability.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance defining a vertical direction, a lateral direction, and a transverse direction, the oven appliance comprising:

a plurality of sidewalls defining a cooking chamber within a cabinet;

a door movable between an open position and a closed position to selectively open and close the cooking chamber; and a bottom panel assembly removably provided within the cooking chamber, the bottom panel assembly comprising:

a panel defining a front end, a rear end opposite the front end, a first side, a second side opposite the first side, and an aperture defined therethrough along the vertical direction;

a front air deflector attached to the panel proximate the aperture, the front air deflector protruding along the vertical direction and at least partially covering the aperture; and a retention clip provided within the cooking chamber, the retention clip defining a receiving slot to selectively receive the panel when the panel is in an installed position, wherein the retention clip comprises:

a first support foot attached to a first side wall of the plurality of sidewalls of the cooking chamber;

a second support foot opposite the first support foot, the second support foot being attached to a second side wall of the plurality of sidewalls of the cooking chamber;

a restraining member connected between the first support foot and second support foot; and a rear air deflector protruding from the restraining member, wherein the rear air deflector is positioned above the panel along the vertical direction.

2. The oven appliance of claim 1, wherein a central portion of the panel is concave along the vertical direction to form a depression therein.

3. The oven appliance of claim 1, wherein the front air deflector comprises:

a base coupled to the panel; and a handle portion extending from the base at an acute angle with respect to the base, wherein the handle portion is provided over at least a portion of the aperture.

4. The oven appliance of claim 3, wherein the aperture and the front air deflector extend along the lateral direction proximate the front end of the panel.

5. The oven appliance of claim 4, wherein the panel is made from a first material and the front air deflector is made from a second material different from the first material.

6. The oven appliance of claim 5, wherein the front air deflector defines an outlet together with the aperture, the outlet being directed toward a center of the cooking chamber.

7. The oven appliance of claim 1, wherein each of the first support foot and the second support foot extend along the lateral and transverse directions.

8. The oven appliance of claim 7, wherein the rear end of the panel is spaced apart from the rear wall of the cooking chamber along the transverse direction, and wherein the retention clip defines a gap between the first support foot and the second support foot along the lateral direction.

9. The oven appliance of claim 8, wherein the restraining member comprises:

a first locking crossmember protruding along the vertical direction; and a second locking crossmember protruding from a distal edge of the first locking crossmember along the transverse direction, wherein the rear air deflector protrudes from a distal edge of the second locking crossmember at an acute angle with respect to the second locking crossmember.

10. The oven appliance of claim 9, wherein the rear end of the panel is received beneath the second locking crossmember along the vertical direction.

11. The oven appliance of claim 10, wherein the rear air deflector protrudes toward the rear wall of the cooking chamber.

12. The oven appliance of claim 1, wherein each of the panel, the front air deflector, and the retention clip are coated with an enamel.

13. A panel assembly for an oven appliance, the oven appliance comprising first and second side walls and a rear wall collectively defining a cooking chamber, the panel assembly comprising:

a panel defining a front end, a rear end opposite the front end, a first side, a second side opposite the first side, and an aperture defined therethrough along the vertical direction, the aperture being positioned proximate a front end of the panel and defining a lateral axis and a transverse axis, the lateral axis being longer than the transverse axis;

a front air deflector attached to the panel proximate the front end, the front air deflector protruding upward along the vertical direction and at least partially covering the aperture, the front air deflector being positioned in front of the aperture along the transverse direction; and a retention clip provided within the cooking chamber, the retention clip defining a receiving slot to selectively receive the panel when the panel is in an installed position, wherein the retention clip comprises:

a first support foot attached to the first side wall of the cooking chamber; and a second support foot opposite the first support foot, the second support foot being attached to the second side wall of the cooking chamber.

14. The panel assembly of claim 13, wherein the front air deflector comprises:

a base coupled to the panel; and a handle portion extending from the base at an acute angle with respect to the base, wherein the handle portion is provided over at least a portion of the aperture.

15. The panel assembly of claim 14, wherein the front air deflector defines an outlet together with the aperture, the outlet being directed toward a center of the cooking chamber.

16. The panel assembly of claim 13, wherein the rear end of the panel is spaced apart from the rear wall of the cooking chamber along the transverse direction, and wherein the retention clip defines a gap between the first support foot and the second support foot along the lateral direction.

17. The panel assembly of claim 16, wherein the retention clip further comprises:

a restraining portion connected between the first and second support feet, wherein the restraining portion comprises:

a first locking crossmember protruding along the vertical direction;

a second locking crossmember protruding from a distal edge of the first locking crossmember along the transverse direction; and a rear air deflector protruding from a distal edge of the second locking crossmember at an acute angle with respect to the second locking crossmember.

18. The panel assembly of claim 17, wherein the rear air deflector protrudes toward the rear wall of the cooking chamber.

* * * * *